US007891862B2

(12) United States Patent
Tu et al.

(10) Patent No.: US 7,891,862 B2
(45) Date of Patent: Feb. 22, 2011

(54) ELECTROMECHANICAL ESCAPEMENT DEVICE AND TIMEPIECE PART UTILIZING SUCH A DEVICE

(75) Inventors: Xuan Mai Tu, Ecublens (CH); Michel Schwab, Bienne (CH)

(73) Assignee: Isa France S.A., Villers-le-Lac (FR)

( * ) Notice: Subject to any disclaimer, the term of this patent is extended or adjusted under 35 U.S.C. 154(b) by 211 days.

(21) Appl. No.: 12/374,669

(22) PCT Filed: Jul. 18, 2007

(86) PCT No.: PCT/CH2007/000346

§ 371 (c)(1),
(2), (4) Date: Feb. 18, 2009

(87) PCT Pub. No.: WO2008/011738

PCT Pub. Date: Jan. 31, 2008

(65) Prior Publication Data

US 2009/0185456 A1 Jul. 23, 2009

(30) Foreign Application Priority Data

Jul. 26, 2006 (CH) ..... 1217/06

(51) Int. Cl.
*G04F 5/00* (2006.01)

(52) U.S. Cl. ..... 368/127; 368/162; 368/163

(58) Field of Classification Search ..... 368/64, 368/66, 124–127, 158, 160–164, 170
See application file for complete search history.

(56) References Cited

U.S. PATENT DOCUMENTS

| | | | | |
|---|---|---|---|---|
| 5,517,469 | A * | 5/1996 | Wiget | 368/140 |
| 5,699,322 | A * | 12/1997 | Born | 368/66 |
| 5,740,131 | A * | 4/1998 | Bernasconi | 368/148 |
| 5,751,666 | A * | 5/1998 | Farine et al. | 368/140 |
| 5,835,456 | A * | 11/1998 | Farine et al. | 368/66 |
| 6,023,446 | A * | 2/2000 | Farine et al. | 368/204 |
| 6,194,862 | B1 * | 2/2001 | Hara | 318/696 |
| 7,016,265 | B2 | 3/2006 | Born et al. | |
| 7,306,364 | B2 * | 12/2007 | Born et al. | 368/148 |

FOREIGN PATENT DOCUMENTS

EP 1158373 A1 11/2001

* cited by examiner

*Primary Examiner*—Vit W Miska
(74) *Attorney, Agent, or Firm*—Pearne & Gordon LLP

(57) ABSTRACT

The electromechanical escapement device is associated with an electronic circuit having a quartz oscillator and calculation means suitable for calculating the difference between the period of the quartz oscillator and the period of a mechanical oscillator and releasing an escape wheel, normally controlled by said mechanical oscillator, when the difference between said periods is greater than a threshold value.

9 Claims, 7 Drawing Sheets

ELECTROMECHANICAL ESCAPEMENT DEVICE AND TIMEPIECE PART UTILIZING SUCH A DEVICE

The content of application No PCT/CH2007/00346, filed Jul. 18, 2007 in Switzerland is hereby incorporated by reference.

BACKGROUND OF THE INVENTION

The object of the present invention is an electromechanical escapement device and a timepiece part utilizing such a device.

For a mechanical timepiece part, the escapement device is used for sustaining the oscillation movement of the mechanical oscillator comprising the balance and the balance spring on the one hand and for transmitting the frequency of this oscillator to the gear-train driving the time display.

Entirely mechanical escapement devices are therefore well-known in the prior art. The manuals "Echappements et moteurs pas à pas" (Escapements and step motors) of Charles Huguenin edited by the Fédération des Ecoles Techniques de Suisse (Swiss Federation of Technical Colleges) and "Théorie d'horlogerie" (Watch-making theory), ISBN 2-940025-10-X, also edited by the Fédération des Ecoles Techniques de Suisse, describe several mechanical escapement devices called <<anchor>>, <<detent>>, <<Graham>> escapements, etc.

As mentioned earlier, traditional mechanical escapement devices directly transmit the frequency of the mechanical oscillator to the gear-train driving the time display. The frequency of the mechanical oscillator, generally comprised between 2 and 4 Hz, is unfortunately not very accurate and further highly dependent on the position of the watch. The accuracy of a mechanical watch is consequently less than that of an electronic quartz watch.

SUMMARY OF THE INVENTION

An object of the present invention is to propose an electromechanical escapement device with which the accuracy of a mechanical watch may be markedly improved.

Another object of the invention is to propose a mechano-electronic timepiece part equipped with such an escapement device.

These objects are achieved by an electromechanical escapement device as described in claim 1, as well as by a timepiece part as described in claim 9. Alternative embodiments are described in the dependent claims.

BRIEF DESCRIPTION OF THE DRAWINGS

The invention will be understood by means of the following description which describes a particular embodiment of the invention, as well as with the appended drawing including the figures, wherein.

DESCRIPTION OF THE PREFERRED EMBODIMENT

Figure 1:
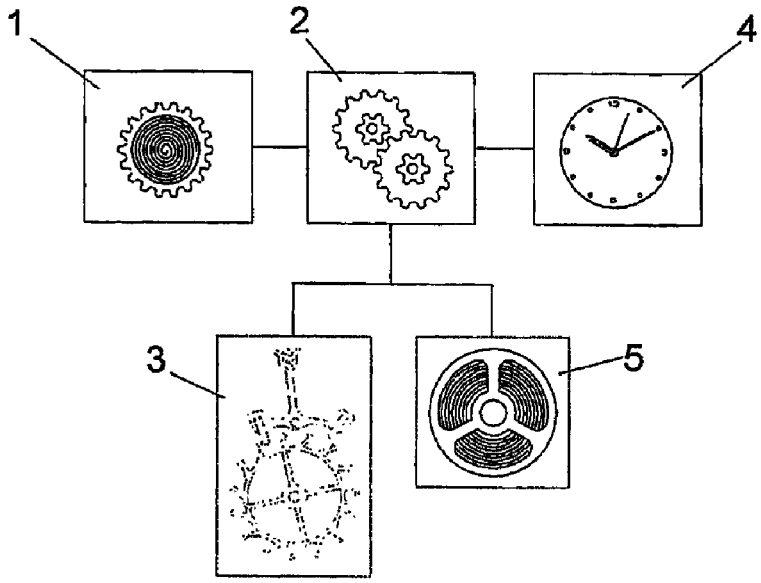
FIG. 1 illustrates a block diagram of a traditional mechanical watch.

FIG. 1 illustrates a block diagram of a traditional mechanical watch in which the mechanical energy from a manual or automatic winding-up device is stored in a barrel spring 1 in order to be distributed through a wheel assembly 2 to an escapement device 3 and to a display 4.

The escapement device 3 is used for sustaining the movement of the mechanical oscillator 5 comprising a balance and a balance spring on the one hand and for transmitting the frequency of this oscillator to the gear-train 2 driving the time display 4 on the other hand. At each oscillation period of the mechanical oscillator 5, the gear-train 2 linked to the display 4, advances by a set angle and consequently the velocity of rotation of the gear-train 2 is proportional to the frequency of the mechanical oscillator 5, so that the accuracy of the display 4 is directly dependent on this frequency.

The frequency of a mechanical oscillator, generally comprised between 2 and 4 Hz, is unfortunately not very accurate and further very dependent on the position of the watch. The accuracy of a traditional mechanical watch is consequently lower than that of an electronic quartz watch.

Figure 2:
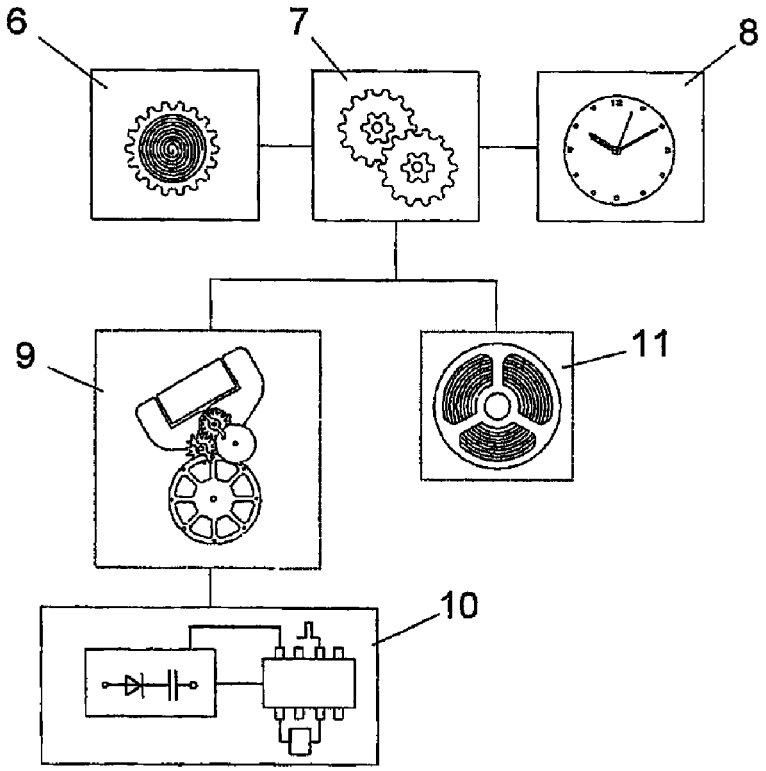
FIG. 2 illustrates a block diagram of a mechano-electronic watch utilizing an electromechanical escapement device according to the invention.

FIG. 2 illustrates a block diagram of a mechano-electronic watch utilizing an electromechanical escapement device according to the invention. The mechanical energy stored in a barrel spring 6 is distributed through an assembly of wheels 7 to an electromechanical escapement device 9 and to a display 8. The electromechanical escapement device 9 according to the invention has multiple functions:

- the first one is to sustain the oscillatory movement of the mechanical oscillator 11,
- the second is to transmit the frequency of the oscillator 11 to the gear-train 7 driving the time display 8,
- the third is to transform a portion of the received mechanical energy into electrical energy for powering the electronic device 10 which has a quartz time base,
- finally, the last function of the electromechanical escapement device 9 is to cause the gear-train 7 to advance when it receives electric correction pulses from the electronic device 10.

It may be noted that on this diagram, the barrel spring 6, the gear-train 7, the display 8, as well as the mechanical oscillator 11, are components identical with those of the same names in FIG. 1.

At each oscillation period of the mechanical oscillator 11, the gear-train 7 linked to the display 8 as well as the electromechanical escapement device 9 advance by a set angle and transmit the electric energy and the oscillation period of the mechanical oscillator 11 to the electronic device 10, through an electromechanical converter of the device 9, described later on. This electronic device 10 has an electric energy accumulator and a quartz time base taken as a reference time base; it compares the mechanical oscillation period with a reference period. When the sum of the differences between these periods exceeds a certain limit, the electronic device 10 sends electric correction pulses through an electromechanical converter in order to cause the electromechanical escapement device 9 as well as the gear-train 7 and the display 8 to advance.

It is seen that unlike a traditional mechanical escapement, the movement of which is synchronous with that of the mechanical oscillator, the electromechanical escapement 9 according to the invention advances at each period of the mechanical oscillator 11 and also, independently of the mechanical oscillator 11, when it receives pulses from the electronic circuit 10.

In order to obtain proper operation of the timepiece part according to FIG. 2, it is sufficient to adjust the period of the mechanical oscillator 11 so as to be slightly longer than that of the reference time base of the quartz time base. The electronic circuit 10 measures the difference between these periods and sends a set of correction pulses in order to make up for lost time. In practice, the adjustment of the period of a mechanical oscillator with an accuracy of one per thousand may easily be achieved.

Figure 3:
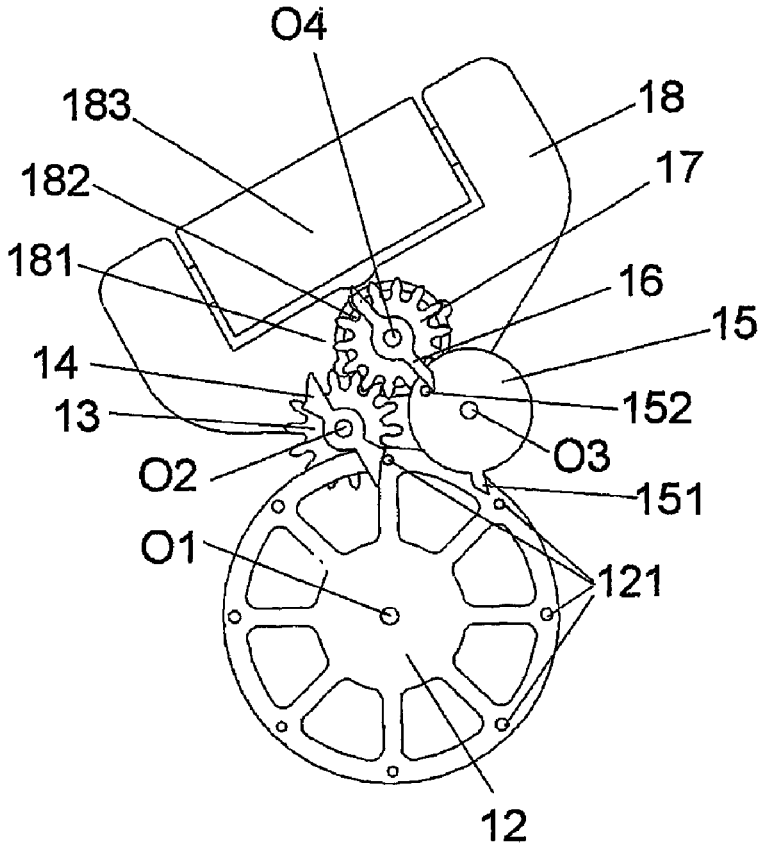
FIG. 3 illustrates an embodiment of an electromechanical escapement according to the invention.

FIG. 3 illustrates an embodiment of an electromechanical escapement device according to the invention. This device comprises several mobile parts rotating around 4 centres O1, O2, O3 and O4.

Figure 4:
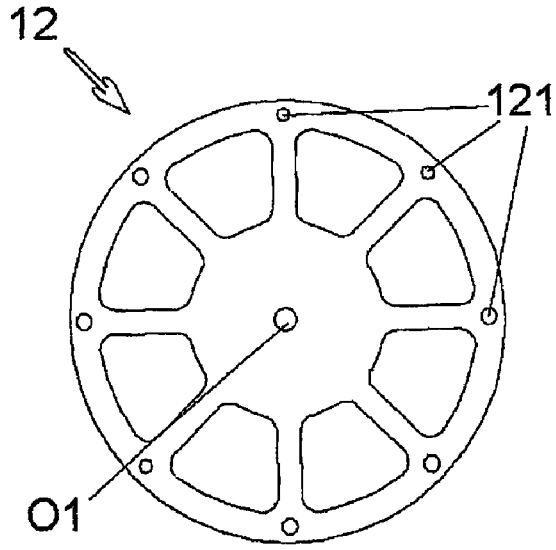
FIG. 4 illustrates details of an escapement wheel.

The escapement wheel 12, illustrated in details in FIG. 4, rotates around the centre O1 and is provided with pins 121. In this example, the number of pins is equal to 8, but selection of another number of pins is also possible.

Figure 5:
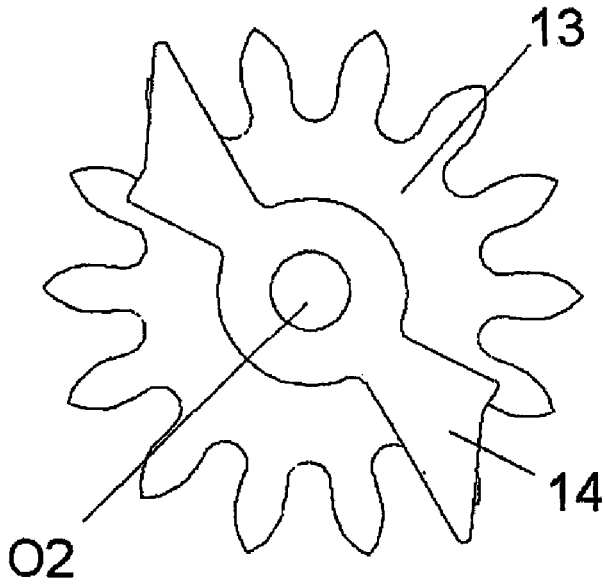
FIG. 5 illustrates details of mobile parts rotating around the centre O2 of FIG. 3.
Figure 6:
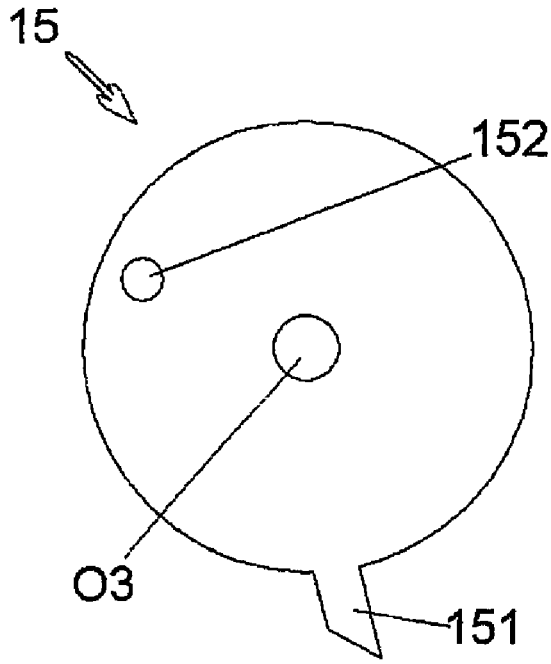
FIG. 6 illustrates details of mobile parts rotating around the centre O3 of FIG. 3.

Two superposed mobile parts simultaneously rotate around the centre O2: a blocking means 14 and a cogwheel 13, both of these mobile parts being illustrated in details in FIG. 5. The mechanical oscillator 11, comprising the balance and the balance spring, rotates around the centre O3. In FIG. 3 as well as in the detailed drawing of FIG. 6, only the disc 15, integral with the balance and including the pulse lever 151 as well as the release pin 152 is illustrated.

Figure 7:
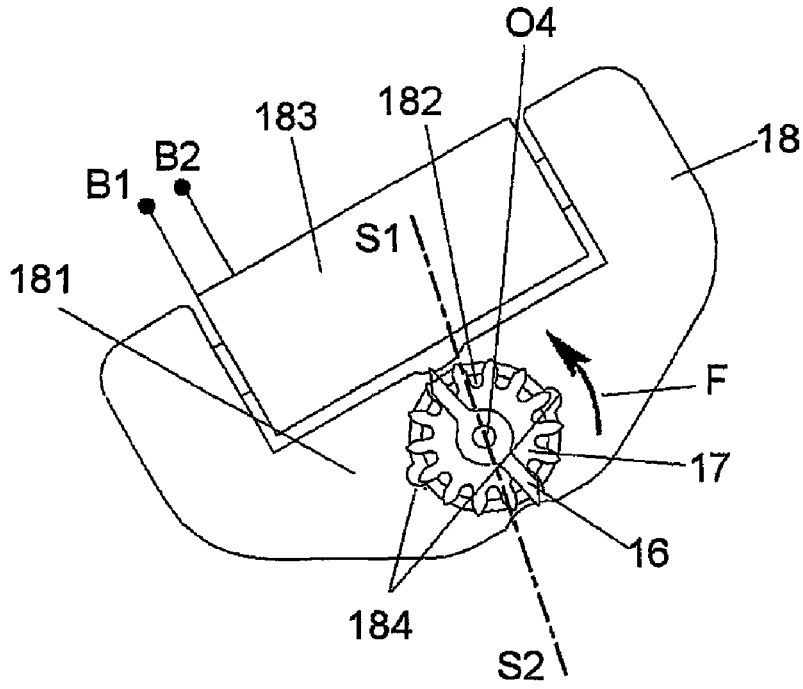
FIG. 7 illustrates details of mobile parts rotating around the centre O4 of FIG. 3 as well as a mechanical converter.

Three superposed mobile parts simultaneously rotate around the centre O4: a mechanical clearing means 16, a cogwheel 17 meshed with the cogwheel 13 and a rotor 182 of the electromechanical converter made as a permanent magnet. FIG. 7 illustrates the details of these mobile parts as well as the electromechanical converter 18 including, in addition to the rotor 182, a stator 181 in a soft magnetic material provided with recesses 184, as well as a coil 183.

The electromechanical converter 18 has several distinct functions:

- by means of the recesses 184, the rotor 182 has two stable positions of equilibrium aligned on the axis S1-S2 in the absence of current in the coil 183,
- when current is provided to the coil 183 with the suitable polarity, the rotor 182 rotates in an anticlockwise direction as indicated by the arrow F,
- finally, when the rotor 182 of the converter 18 is driven by the escapement wheel 12 via the cogwheels 13 and 17, this converter 18 operates as a generator and provides a voltage on the terminals B1 and B2 of the coil 183.

Figure 8:
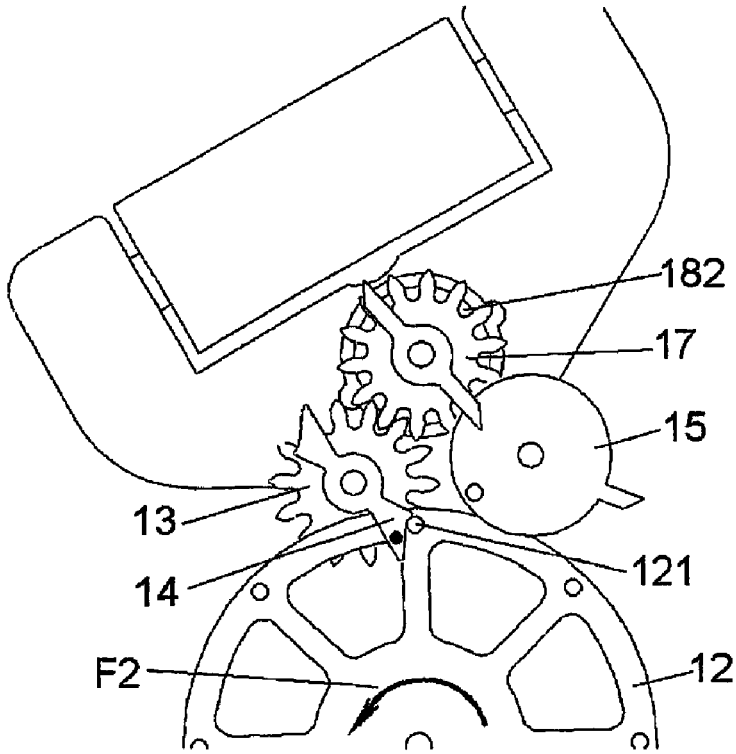
FIG. 8 illustrates the blocking position.
Figure 9:
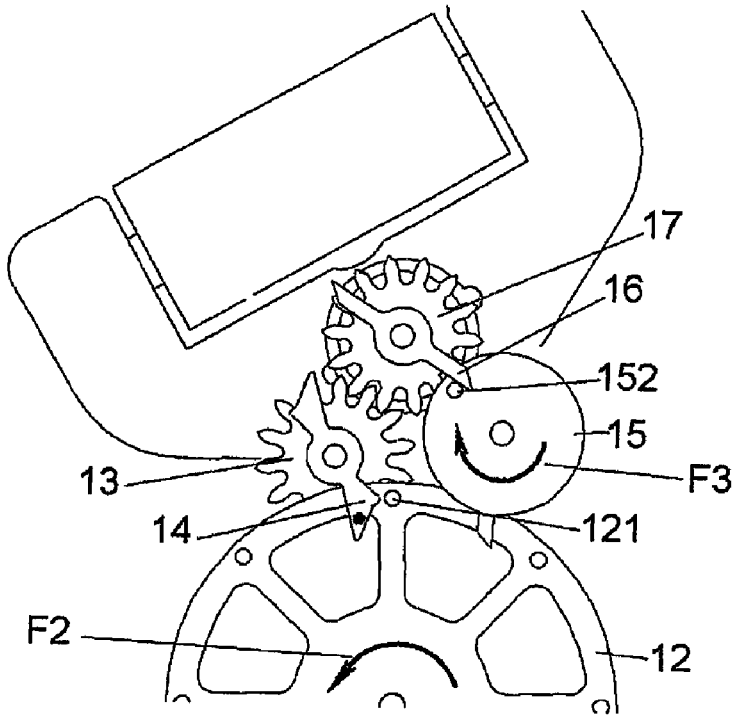
FIG. 9 illustrates the mechanical release phase.
Figure 10:
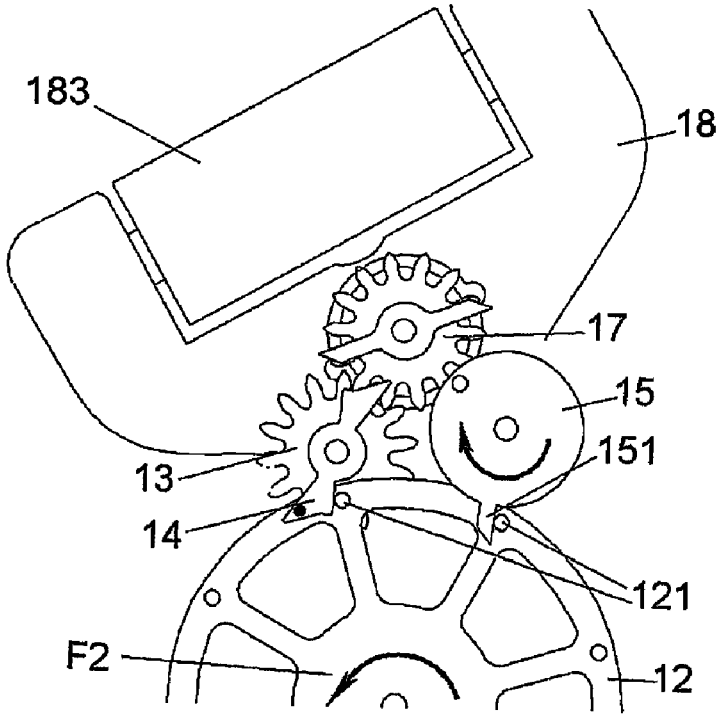
FIG. 10 illustrates the energy transmission phase.
Figure 11:
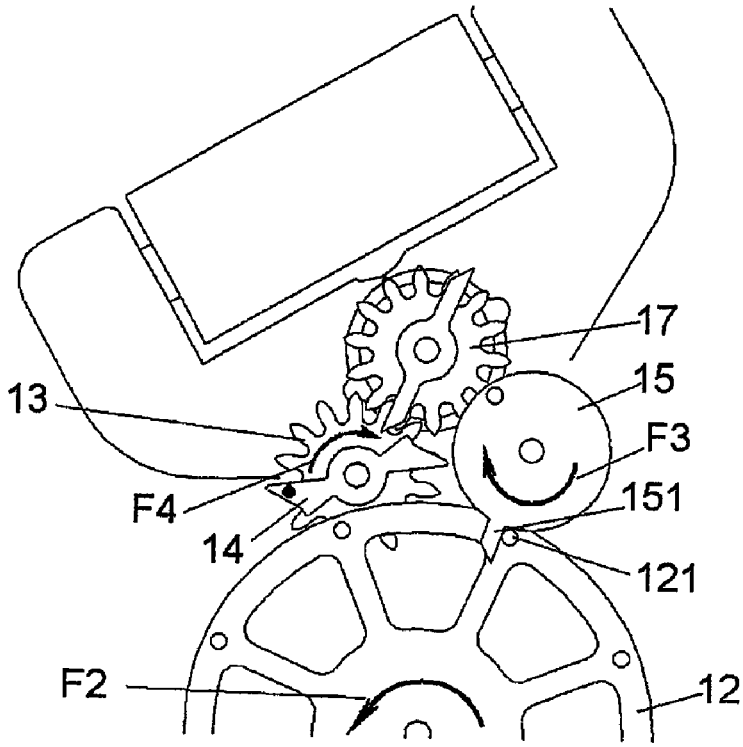
FIG. 11 illustrates the repositioning phase.
Figure 12:
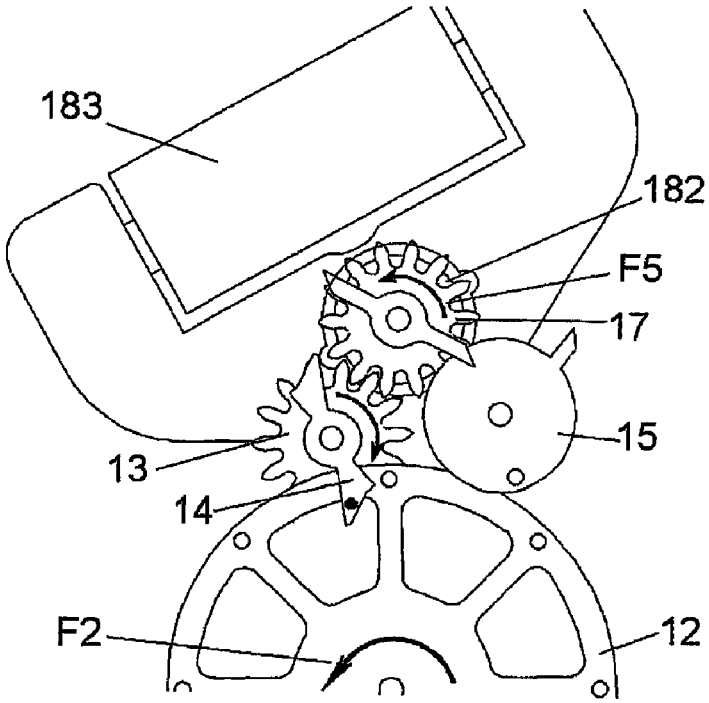
FIG. 12 illustrates the electromagnetic release phase.

The operation of the electromechanical escapement device according to the invention is described below, comprising several main phases:

- blocking phase: most of the time, when the disc 15 of the mechanical oscillator 11 is not in mechanical contact with the escapement wheel 12 via the pulse lever 151, or with the release means 16 via the release pin 152, the escapement wheel 12 is found in the blocking position. FIG. 8 illustrates this blocking position. In this figure, the escapement wheel 12 is subject to a torque from the barrel 6 in the direction indicated by the arrow F2. By means of the shape of the blocking means 14 and of the magnetic positioning torque from the rotor 182 via the wheels 17 and 13, the escapement wheel 12 is blocked in this position while the disc 15 of the mechanical oscillator 11 continues with its movement.
- Mechanical release phase: FIG. 9 illustrates the mechanical release phase. In this figure, the pin 152 of the disc 15, rotating in the direction of the arrow F3, actuates the release means 16 and via the wheels 17 and 13, releases the pin 121 from the blocking means 14. The escapement wheel 12 may rotate, under the effect of the torque transmitted by the barrel 6 in the direction of the arrow F2.
- Energy transmission phase: in this phase, the escapement wheel 12 transmits the energy to the mechanical oscillator 11 as well as to the electromechanical converter 18. FIG. 10 illustrates this energy transmission phase. After the mechanical release phase, the escapement wheel 12 rotates in the direction of the arrow F2, one of the pins 121 of this wheel actuating the pulse lever 151 of the disc 15, in order to provide the energy intended for sustaining the movement of the oscillator 11. The pin 121 preceding the one mentioned above in the direction of rotation, actuates the blocking means 14, which transmits the mechanical energy via the wheels 13 and 17 to the electromechanical converter 18 which transforms it into electric energy on the terminals of the coil 183.
- Repositioning phase: this phase is illustrated by FIG. 11. After the energy transmission phase, the blocking means 14 and wheel 13 continue to rotate in the same direction as indicated by the arrow F4 and, under the effect of the magnetic positioning torque, again find a new blocking position at 180 degrees relatively to the preceding blocking position. In this phase, the escapement wheel 12 continues to provide energy to the mechanical oscillator 11 via the pulse lever 151 of the disc 15.
- Electromagnetic release phase: this phase is illustrated by FIG. 12. One of the particularities of the electromechanical escapement device according to the invention is that it is able to release the escapement wheel 12 from the blocking position, independently of the frequency of the mechanical oscillator 11. To do this, it is sufficient to send a set of electric pulses to the coil 183 of the electromechanical converter 18. The interaction between the magnetic field generated by the current in the coil 183 and the magnetic field of the magnet of the rotor 182 generates an electromagnetic torque in the direction of the arrow F5, larger than the positioning torque which actuates the blocking means 14 in the opposite direction via the wheels 13 and 17. The electromagnetic release phase is generally carried out outside the mechanical release, energy transmission and repositioning phases. During this phase, the angular velocity of the mechanical oscillator 11 is practically zero. In this phase of electromagnetic release, the escapement wheel 12 does not transmit any energy to the mechanical oscillator 11.

Figure 13:
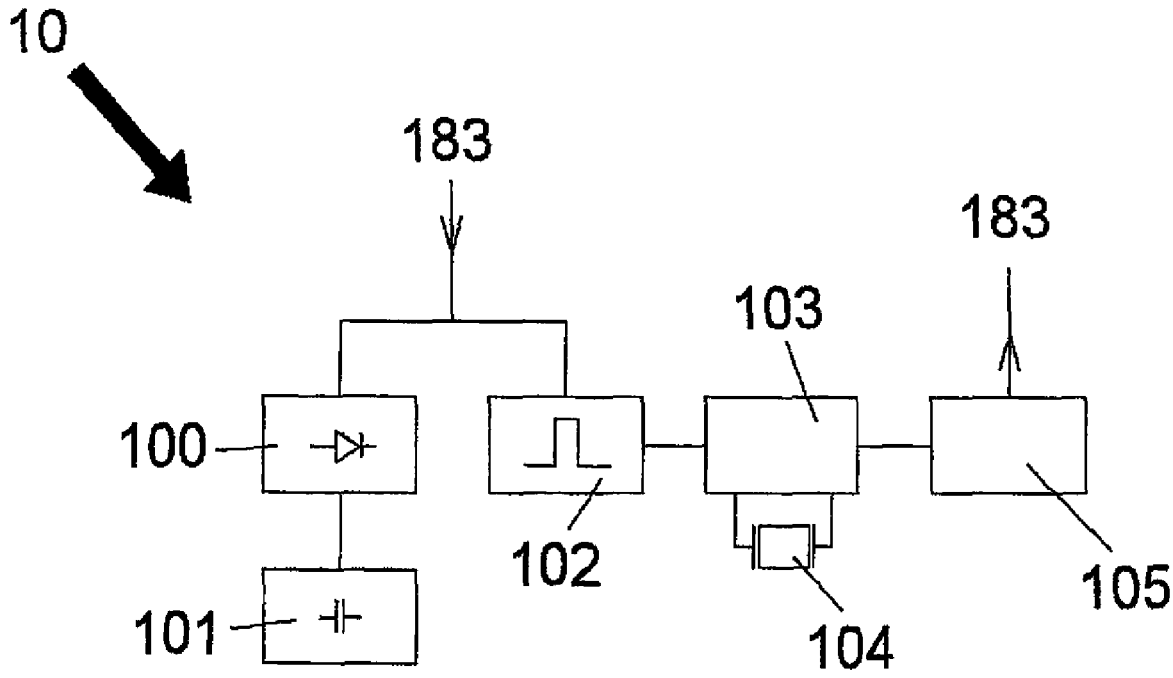
FIG. 13 illustrates a block diagram of an associated electronic device.

FIG. 13 illustrates the block diagram of the electronic device 10 of FIG. 2. This device comprises:

- charging means 100,
- energy storage means 101,
- means 102 for shaping the voltage from the coil 183,
- means 103 for measuring the period of the mechanical oscillator 11 based on a reference time base from a quartz oscillator 104,
- means 105 for calculating and providing a set of electric correction pulses.

The electrical signal from the coil 183 during the energy transmission phase is sent to the charging means 100 which store the energy in a condenser or another energy accumulator 101. This signal is also sent to the shaping means 102 which transmit the information to the means 103 for measuring the period of the mechanical oscillator 11, based on a reference time base from a quartz oscillator 104. The means 105 calculate the sum of the errors of the mechanical period and send a set of electric correction pulses from the coil 183 when this sum exceeds a certain limit.

A particular embodiment of the electromechanical escapement device was described above; it is quite obvious that alternative designs may be contemplated. In particular, the mechanical link between the mechanical blocking means, the mechanical release means as well as the rotor, described here in the form a two cogwheels, may be different from those described, subject to providing the same function. Other design alternatives, which may be contemplated by one skilled in the art, should also be considered.

Thus, a timepiece part equipped with an electromechanical escapement device as described above has its operative accuracy notably improved since the latter then depends on the accuracy of the quartz oscillator.

The invention claimed is:

1. An electromechanical escapement device, as a component of a mechanical timepiece movement including a mechanical oscillator comprising:

an escapement wheel, mechanical blocking means mounted on an axis, mechanical release means mounted on another axis, an electromechanical converter comprising a stator in a magnetic material, a rotor as a permanent magnet and a coil, mechanical driving means connecting both axes as well as the rotor, the blocking means being able to periodically immobilize the escapement wheel according to well-determined angular positions, the mechanical release means being able to release the escapement wheel until the next blocking position, synchronously with the mechanical oscillator, the escapement wheel being able, upon pivoting between two successive blocking positions, to provide the energy required by the mechanical oscillator in order to sustain its oscillatory movement on the one hand, and to cause the blocking device to pivot on the other hand, causing pivoting of the rotor via the mechanical driving device, thereby providing electric energy to the coil, said electromechanical escapement device being associated with an electronic circuit including a quartz time base, said electronic circuit being able to provide a set of electric pulses to the coil, in order to control a pivoting of the rotor causing pivoting of the blocking means and release of the escapement wheel right up to its next blocking position, independently of the frequency of the mechanical oscillator.

2. The electromechanical escapement device according to claim 1, wherein the rotor has a positioning torque determining two stable positions of equilibrium in the absence of current in the coil.

3. The electromechanical escapement device according to claim 2, wherein the stable positions of equilibrium are determined by two recesses arranged in the periphery of the housing of the rotor in the stator.

4. The electromechanical escapement device according to claim 2, wherein the voltage provided by the coil for pivoting the rotor provides a larger electromagnetic torque than the positioning torque.

5. The electromechanical escapement device according to claim 1, wherein the electronic circuit which is associated with it, further comprises:

energy storage means supplied with electric energy upon pivoting the escapement wheel via charging means, means for shaping the voltage from the coil powering, means for measuring the oscillation period of the mechanical oscillator, calculation means able to calculate the sum of the differences between the oscillation period of the mechanical oscillator and the period provided by the quartz time base and to provide a set of electric pulses to the coil when this difference exceeds a determined limit.

6. The electromechanical escapement device according to claim 5, wherein the associated electronic circuit is able to provide the set of electric pulses to the coil only when the angular oscillation velocity of the mechanical oscillator is substantially less than its maximum value.

7. The electromechanical escapement device according to claim 5, wherein the associated electronic circuit is able to provide the set of electric pulses to the coil only when the escapement wheel is in the blocked position.

8. The electromechanical escapement device according to claim 5, wherein the oscillation period of the mechanical oscillator is longer than the oscillation period of the quartz time base.

9. A timepiece part including a mechanical timepiece movement equipped with an electromechanical escapement device as set forth in claim 1.

* * * * *